United States Patent [19]

Ozaki et al.

[11] Patent Number: 5,047,310

[45] Date of Patent: Sep. 10, 1991

[54] PHOTOGRAPHIC PROCESS OF HEATING DURING DEVELOPMENT AFTER IMAGE EXPOSURE WITH A CONDUCTIVE LAYER CONTAINING CARBON BLACK

[75] Inventors: Hiroyuki Ozaki; Hideki Naito; Satoru Sawada, all of Kanagawa, Japan

[73] Assignee: Fuji Photo Film Co., Ltd., Kanagawa, Japan

[21] Appl. No.: 942,958

[22] Filed: Dec. 16, 1986

Related U.S. Application Data

[62] Division of Ser. No. 809,671, Dec. 16, 1985, abandoned.

[30] Foreign Application Priority Data

Dec. 19, 1984 [JP] Japan ..... 59-268032

[51] Int. Cl.[5] ..... G03C 5/54

[52] U.S. Cl. ..... 430/203; 430/348; 430/350; 430/623; 430/913

[58] Field of Search ..... 428/913; 430/50, 348, 430/350, 203, 523

[56] References Cited

U.S. PATENT DOCUMENTS

| | | | |
|---|---|---|---|
| 2,317,789 | 4/1943 | Merriott | 430/348 |
| 3,269,252 | 8/1966 | DeHeyser et al. | 430/527 |
| 3,441,940 | 4/1969 | Salaman et al. | 430/348 |
| 3,445,654 | 5/1969 | Lofrest | 430/348 |
| 3,476,937 | 11/1969 | Vrancken | 430/203 |
| 3,542,545 | 11/1970 | Goffe | 430/50 |
| 3,630,740 | 12/1971 | Joseph et al. . | |
| 3,655,371 | 4/1972 | Chafaris | 430/50 |
| 3,738,137 | 7/1973 | Worth et al. . | |
| 3,743,608 | 7/1973 | Habu et al. . | |
| 3,847,838 | 11/1974 | Habu et al. . | |
| 3,887,787 | 6/1975 | Gregg | 430/617 |
| 4,070,189 | 1/1978 | Kelley et al. . | |
| 4,120,722 | 10/1978 | Okamoto et al. | 430/619 |
| 4,173,677 | 11/1978 | Nakano et al. | 430/336 |
| 4,259,424 | 3/1981 | Endo et al. | 430/48 |
| 4,374,916 | 2/1983 | Lelental et al. . | |
| 4,409,316 | 10/1983 | Eller-Pendre et al. | 430/268 |
| 4,418,141 | 11/1983 | Kawaguchi et al. . | |
| 4,460,636 | 7/1984 | Watanbe . | |
| 4,495,276 | 1/1985 | Takemoto et al. . | |
| 4,500,626 | 2/1985 | Naito et al. . | |
| 4,525,722 | 6/1985 | Sachdev et al. . | |
| 4,643,964 | 2/1987 | Sawada et al. | 430/617 |

*Primary Examiner*—Jack P. Brammer

*Attorney, Agent, or Firm*—Sughrue, Mion, Zinn, Macpeak & Seas

[57] ABSTRACT

A photographic material is disclosed, which comprises a support having provided thereon at least one electrically conductive layer, said conductive layer comprising carbon black having a dibutyl phthalate absorption capability of at least 80 cc/100 g and a hydrophilic binder.

13 Claims, No Drawings

PHOTOGRAPHIC PROCESS OF HEATING DURING DEVELOPMENT AFTER IMAGE EXPOSURE WITH A CONDUCTIVE LAYER CONTAINING CARBON BLACK

This is a divisional of application Ser. No. 06/809,671, filed Dec. 16, 1985, now abandoned.

FIELD OF THE INVENTION

This invention relates to a photographic material which forms an image upon being heated or which provides a transferred image upon being heated and, more particularly, to the above described photographic material which has a conductive layer undergoing less fluctuation of electric resistance for change of ambient humidity.

BACKGROUND OF THE INVENTION

Heat-developable light-sensitive materials and their processes are described, for example, in *Shashin Kogyo no Kiso* (published by Corona Co. in 1979), pp. 553 to 555, *Eizo Joho* (April, 1973), p. 40, *Neblette's Handbook of Photography and Reprography*, 7th Ed. (published by Van Nostrand Reinhold Company), pp. 32–33, U.S. Pat. Nos. 3,152,904, 3,301,678, 3,392,020, 3,457,075, British Patents 1,131,108, 1,167,777, and *Research Disclosure* RD No. 17029 (June, 1978), pp. 9–15.

Processes for transferring mobile dyes imagewise formed by heat development to an image receiving layer by heating, and image receiving materials for use therewith, are described in Japanese Patent Application (OPI) Nos. 58543/83 (corresponding to U.S. Pat. No. 4,500,626), 79247/83 (corresponding to U.S. Pat. No. 4,483,914), 168439/84 (corresponding to U.S. Pat. application Ser. No. 509,592 (Mar. 16, 1984)), (the term "OPI" as used herein refers to a "published unexamined Japanese patent application"), etc.

Methods for heating the heat-developable light-sensitive materials or the image receiving materials (hereinafter collectively referred to as photographic materials) include a method of bringing a photographic material into contact with a high heat capacity hot plate, a method of directly heating a photographic material by irradiating with a laser, infrared rays, ultrasonic waves, high frequency waves, etc., and a method of passing a photographic material through a hot gas zone. However, these methods fail to provide fully satisfactory results due to their various defects. For example, with the method of using a hot plate, it takes a long time to uniformly heat the hot plate and, therefore, the method requires a large electrical energy and, when the contact is insufficient, uniform conduction of the heat to the photographic material is difficult. With the method of using radiation such as a laser, a large sized equipment required makes it difficult to build a compact system, and the method of utilizing gas has the defect that it takes a long time due to the small heat capacity of gas.

In order to overcome these defects, a process of using an electrically conductive heating element layer in combination with a heat-developable light-sensitive layer has been described in Japanese Patent Application (OPI) No. 66442/73 (corresponding to U.S. patent application Ser. No. 206,368), etc. However, since this electronically conductive heating element layer is formed by coating an organic solvent solution, explosion-proof equipment is required for the coating process, and hence this process has defects with respect to safety, economic aspects, and practical workability.

In addition, the inventors have previously invented a heat-developable light-sensitive material having an electrically conductive layer wherein a conductivity imparting substance is dispersed in a hydrophilic binder as described in Japanese Patent Application (OPI) No. 120356/85 and Japanese Patent Application No. 151815/84 (corresponding to U.S. patent application Ser. No. 757,556 (July 22, 1985)).

However, these conventional conductive layers undergo serious changes in their electric resistance when the ambient humidity varies. Therefore, there arises a problem that, when humidity varies, the density of an image formed by heat development or a heat transfer process fluctuates. Of course, this problem can be solved to some extent by changing energizing conditions, but it is quite troublesome to change energizing conditions depending upon ambient humidity, and, in some cases, fluctuation of the resistance value exceeds the scope within which energizing control can be effective. Thus, the controlled energizing technique cannot be a sufficient solution for the above described problem.

SUMMARY OF THE INVENTION

Therefore, one object of the present invention is to provide a photographic material having an electrically conductive layer which shows significantly less fluctuation of electric resistance for a given change in the ambient humidity.

Another object of the present invention is to provide a photographic material having an electrically conductive layer which shows significantly less fluctuation of electric resistance for a given change in the ambient humidity, and which does not require explosion-proof coating equipment.

These and other objects of the present invention will become apparent from the following description thereof.

These and other objects of the present invention described above are attained by a photographic material which comprises a support having provided thereon at least one electrically conductive layer, said conductive layer comprising carbon black having a dibutyl phthalate (DBP) absorption capability of at least 80 cc/100 g and a hydrophilic binder.

DETAILED DESCRIPTION OF THE INVENTION

Carbon black to be used in the present invention absorbs the DBP in an amount of at least 80 cc/100 g measured according to either method A or method B provided in JIS-K-6221.

Such carbon black can be readily selected, and are available from Cabot Corporation, Lion Akzo Co., Columbian Carbon Japan Ltd., etc. Preferable examples include BLACK PEARLS 1300, BLACK PEARLS 1000, BLACK PEARLS 880, BLACK PEARLS 700, BLACK PEARLS 2000, VULCAN XC-72, VULCAN P, VULCAN 9, REGAL 300R, ELFTEX PELLETS 115, ELFTEX 8, EFTEX 12, STERLING SO, and STERLING V (trademarked products of Cabot Corp.), KETJENBLACK EC (trademarked product of Japan EC Co., sold by Lion Akzo Co.), ROYAL SPECTRA, NEO SPECTRA MARK I and II, NEO SPECTRA AG, SUPERBA (NEO MK II), NEO SPECTRA MARK IV, RAVEN 5000, RAVEN 7000, RAVEN 5750, RAVEN 5250, RAVEN 3500, RAVEN 3200, RAVEN 1040, RAVEN 890 POWDER, RAVEN 890H POWDER, RAVEN 825 BEADS, RAVEN 500, CONDUCTEX 40-220, CONDUCTEX 975 BEADS, CONDUCTEX 900 BEADS, CONDUCTEX SC, RAVEN H20 POWDER, RAVEN C BEADS, RAVEN 22 POWDER, RAVEN 16 POWDER, RAVEN 14 POWDER, etc. (trademarked products of Columbian Carbon Japan Co.).

The electrically conductive layer of the photographic material in accordance with the present invention shows significantly less fluctuation of electric resistance for a given change in the ambient humidity. This effect increases as the amount of absorbable DBP increases. Therefore, in a preferable embodiment of the present invention, carbon black capable of absorbing DBP in an amount of at least 100 cc/100 g, and more preferably at least 150 cc/100 g is used. The reason for such effect is not clear, but carbon black capable of absorbing DBP in an amount of at least 80 cc/100 g has properties such that it has a large surface area, a well developed structure, a small primary particle size, a small bulk density (in some cases having a hollow structure, such as KETJEN BLACK EC sold by Lion Akzo Co.), and these properties are believed to function individually or collectively to exhibit the above described effects.

The hydrophilic binder to be used in the present invention can be used alone or in combination. The hydrophilic binder is typically exemplified by transparent or semitransparent colloids, and includes, for example, natural products such as proteins (e.g., gelatin, gelatin derivatives, etc.), polysaccharides (e.g., cellulose derivatives, starch, gum arabic, etc.), etc., and synthetic polymers such as water-soluble polyvinyl compounds (e.g., polyvinylpyrrolidone, acrylamide polymer, etc.). Of these, gelatin and polyvinyl alcohol are preferable, with gelatin being particularly preferable.

As the hydrophilic binder, hydrophilic electrically conductive polymers can be used alone, or more preferably, in combination with the above mentioned hydrophilic binders. Such hydrophilic conductive polymers include cationic polymeric electrolytes such as polypiperidinium chloride, polyvinylbenzyltrimethylammonium chloride, etc.

The amounts of carbon black and binder can be decided according to the desired electric resistance. According to the present inventin, it is generally desired that the volume resistance of dry film ranges from $10^{-4}$ to $10^{-4}$ Ω cm, and preferably from $10^{-1}$ to $10^{1}$ Ω cm, and the amount of carbon black necessary for obtaining the desired volume resistance is generally from 10 to 90 wt %, preferably from 15 to 85 wt %, and more preferably from 20 to 70 wt %. Particularly, good results can be obtained by using carbon black in an amount of from about 1 g to about 50 g/m$^2$, and preferably from about 2 g to about 20 g/m$^2$.

To the electrically conductive layer of the present invention may be added, if desired, other conductivity imparting substances such as metals (e.g., iron, copper, nickel, platinum, etc.), alloys containing nickel and chromium as major components and known as nichrome wire and Kanthal wire, noble metal alloys (e.g., platinum-rhodium alloy, etc.), oxide semiconductors (e.g., silicon carbide, molybdenum silicide, zirconia ($ZrO_2$), zinc oxide, titanium oxide, thoria ($ThO_2$), etc., in the form of, preferably, a powder. If desired, hardeners or surfactants as described hereinafter may also be added.

The present invention may be applied not only to heat-developable black-and-white image forming light-sensitive materials which comprise a support having provided thereon light-sensitive silver halide, a binder, an organic silver salt oxidant, and a reducing agent, but advantageously to heat-developable color image forming light-sensitive materials which comprise a support having provided thereon light-sensitive silver halide, a binder, and a dye providing substance capable of producing or releasing mobile dye as a function (direct or inverse) of reduction of the light-sensitive silver halide to silver under heating to high temperatures and to image receiving materials (dye fixing materials) which receive mobile dyes formed by using the above described color image forming heat-developable light-sensitive materials.

In the present invention, the electrically conductive layer and the photographic layers (e.g., image receiving layer, light-sensitive layer, etc.) may be provided on the same side, or on opposite sides with respect to each other, of the support; or alternatively, the electrically conductive layer may be provided on a different support and may, at a proper stage, be superposed on the image receiving material. In short, any embodiment may be employed as long as heat generated by energizing the electrically conductive layer can be conducted to the photographic layer and the temperature of said photographic layer can be raised to a temperature necessary for development or image transfer.

Where the electrically conductive layer and the photographic layer are provided on different sides of the same support, curl balance of the resulting photographic material can be facilitated, thus such structure being preferable. In particular, the use of a water-soluble binder for the electrically conductive layer is preferable since the same kind of layers are provided on both sides of the support.

Examples of the relative locational relationship of the electrically conductive layer and the light-sensitive layer or the image receiving layer are shown below:

- Conductive layer/support/light-sensitive or image receiving layer;
- Support/conductive layer/light-sensitive or image receiving layer;
- Support/conductive layer/interlayer/light-sensitive or image receiving layer;
- Support/light-sensitive or image receiving layer/-conductive layer; and
- Support/light-sensitive or image receiving layer/interlayer/conductive layer.

Silver halide to be used in the present invention may be any of silver chloride, silver bromide, silver chlorobromide, silver chloroiodide, silver bromoiodide, and silver chlorobromoiodide. Halide composition within the grains may be uniform.

Grains having a layered structure wherein the composition of the surface portion is different from that of the internal portion (Japanese Patent Application (OPI) Nos. 154232/82 (corresponding to U.S. Pat. No. 4,444,877), 108533/83, 48755/84 (corresponding to U.S. Pat. No. 4,507,386), and 52237/84, U.S. Pat. No. 4,433,048, and European Patent 100,984) amy be used. In the case of using silver halide independently without using the organic silver salt oxidizing agent, silver chloroiodide, silver bromoiodide, and silver chlorobromoiodide showing an X-ray pattern which reveals existence of silver iodide crystal are preferably used. Silver bromoiodide having such properties can be obtained, for example, by adding a silver nitrate solution to a potassium bromide solution to prepare silver bromide grains and further adding thereto potassium iodide. In addition, plate-like grains having a thickness of 0.5 μm or less, a diameter of at least 0.6 μm, and an average aspect ratio of 5 or more (U.S. Pat. Nos. 4,414,310 and 4,435,499, West German Patent (OLS) No. 3,241,646$A_1$, etc.), and monodisperse emulsions having an approximately uniform grain size distribution (Japanese Patent Application (OPI) Nos. 178235/82 (corresponding to U.S. Pat. No. 4,446,228), 100846/83 (corresponding to U.S. Pat. Nos. 4,446,226 and 4,511,648), 14829/83, International Patent Application Laid Open No. 83-0233$ZA_1$, European Patents 64,412$A_3$ and 83,377$A_1$, etc.) may be used. Epitaxial junction type silver halide grains may also be used (Japanese Patent Application (OPI) No. 16124/81 (corresponding to U.S. Pat. No. 4,349,622), and U.S. Pat. No. 4,094,684). Two or more silver halides different from each other in crystal habit, halide composition, grain size, grain size distribution, etc., may be used in combination. It is also possible to adjust gradation by properly mixing two or more monodisperse emulsions having different grain sizes.

Grain size of silver halide to be used in the present invention preferably ranges from 0.001 μm to 10 μm, more preferably 0.001 μm to 5 μm. Further, water-soluble iridium salts such as iridium (III, IV) chloride and ammonium hexachloroiridate and water-soluble rhodium salts such as rhodium chloride may be used for improving reciprocity law failure in high illuminance region and low illuminance region.

The silver halide emulsions may be used as primitive emulsions, but are usually used after chemical sensitization. Chemical sensitization can be conducted using a sulfur sensitization process, a reduction sensitization process, a noble metal sensitization process, etc., independently or in combination. These sensitizing processes may be conducted in the presence of a nitrogen-containing heterocyclic compound (Japanese Patent Application (OPI) Nos. 126526/83 and 215644/83).

The silver halide emulsion to be used in the present invention may be of the type forming latent image mainly on the surface of silver halide grains or of the type forming latent image mainly within them. Direct reversal emulsions wherein an internal latent image type emulsion is combined with a nucleating agent may also be used.

In the present invention, the light-sensitive silver halide emulsion layer is coated in a silver amount of from 1 mg to 10 mg/$m^2$.

In the present invention, an organic silver salt comparatively stable against light may be used as an oxidizing agent together with light-sensitive silver halide. In this case, light-sensitive silver halide and the organic silver salt must be in contact with each other or within a close distance from each other. Organic metal oxidizing agents are believed to participate in redox reaction as a catalyst of silver halide having a latent image, when heated to 80° C. or above, and preferably 100° C. or above.

As the organic compounds usable for forming such organic silver salt oxidizing agents, there are illustrated aliphatic or aromatic carboxylic acids, compounds with a mercapto group or α-hydrogen-containing thiocarbonyl group, imino group-containing compounds, etc.

Specific examples of useful organic silver salt oxidizing agents are those described in Japanese Patent Application (OPI) No. 58543/83, p. 19, left and lower column to p. 20, right and upper column (corresponding to U.S. Pat. No. 4,500,626, col. 52–53).

In the present invention, compounds which, when light-sensitive silver halide is reduced to silver at elevated temperatures, produce or release mobile dyes as a function (direct or inverse) of this reaction, that is, dye providing substances, may be incorporated.

The dye providing substances are described in detail below.

As the examples of the dye providing substances to be used in the present invention, there are first illustrated couplers capable of reacting with a developing agent. This coupler-utilizing process is a process wherein an oxidation product of a developing agent produced by oxidation reduction reaction between the silver salt and the developing agent, and is described in many documents. Specific examples of the developing agents and the couplers are described, for example, in T. H. James, *The Theory of the Photographic Process*, 4th Ed., pp. 291–334 and 354–361, Shinichi Kikuchi, Shashin Kagaku, 4th Ed. (published by Kyoritsu Shuppan Co.), pp. 284–295, etc.

Dye silver compounds wherein an organic silver salt is bound to a dye are also among the examples of the dye providing substances. Specific examples of the dye silver compounds are described in *Research Disclosure*, RD No. 16966, (May, 1978), pp. 54–55, etc.

In addition, azo dyes to be used for a heat-developable silver dye bleach process are also among the dye providing substances. Specific examples of the azo dyes and bleaching process are described in U.S. Pat. No. 4,235,957, *Research Disclosure*, RD No. 14433 (April, 1976), pp. 30–32, etc.

Furthermore, leuco dyes described in U.S. Pat. Nos. 3,985,565, 4,022,617, etc., are also among the dye providing substances.

As examples of another class dye providing substances, there are illustrated those compounds which can imagewise release or diffuse a diffusible dye.

This class of compounds can be represented by formula (LI)

$$(\text{Dye}—X)_n—Y \qquad \text{(LI)}$$

wherein Dye represents a dye or a dye precursor group, X represents a mere bond or a linking group, Y represents a group which causes difference in diffusibility of the compound represented by $(\text{Dye}—X)_n—Y$ in direct or inverse conformity with light-sensitive silver salt having an imagewise latent image, or which releases Dye in direct or inverse conformity with light-sensitive silver salt having an imagewise latent image to cause difference in diffusibility between the released dye and $(\text{Dye}—X)_n—Y$, and n represents 1 or 2. and when n represents 2, the two Dye—X's are the same or different.

As the specific examples of the dye providing substances represented by formula (LI), dye developers wherein a hydroquinone type developing agent is linked to a dye moiety are described, for example, in U.S. Pat. Nos. 3,134,764, 3,362,819, 3,597,200, 3,544,545, 3,482,972, etc.

In addition, Japanese Patent Application (OPI) No. 63618/76, etc., describe substances which release a diffusible dye as a result of intramolecular nucleophilic substitution reaction, and Japanese Patent Application (OPI) No. 111628/74, etc., describe substances which release a diffusible dye as a result of intramolecular recyclizing reaction. These are processes wherein diffusible dyes are to be released or diffused in the portions where no development has taken place, and no dyes are released or diffused in the portions where development has taken place.

In addition, with these processes, it is difficult to provide images having a high S/N ratio since development and release or diffusion of dye take place in parallel. In order to remove this defect, it has been proposed to convert the dye releasing compounds into oxidized form thereof having no dye releasing ability, allow the oxidized form compounds to coexist with a reducing agent or its precursor, and, after development, reduce the oxidized form of the compounds with the remaining reducing agent not having been oxidized. Specific examples of the dye providing substances to be used for the processes are described in Japanese Patent Application (OPI) Nos. 110827/78, 130927/79, 164342/81, 35533/78, etc.

On the other hand, as substances which release a diffusible dye in portions where development has taken place, those substances which release a diffusible dye upon reaction between a coupler having a diffusible dye as an elminatable group and an oxidation product of a developing agent are described in British Patent 1,330,524, Japanese Patent Publication No. 39165/73, U.S. Pat. No. 3,443,940, etc., and those substances which release a diffusible dye upon reaction between a coupler having a diffusion resistant group as an eliminatable group and an oxidation product of a developing agent are described in U.S. Pat. No. 3,227,550, etc.

In these processes using color developer, there arises a serious problem of image stain with an oxidation decomposition product of the developing agent. In order to solve this problem, dye releasing compounds which do not require any developing agent and which themselves have reducing properties have been proposed. Typical examples thereof are shown below together with literature. Definitions with respective formulae are found in the literature, and include compounds such as

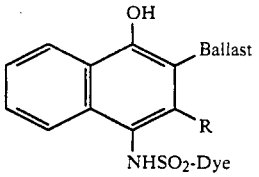

U.S. Pat. No. 3,928,312

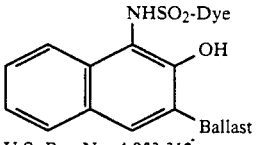

U.S. Pat. No. 4,053,312

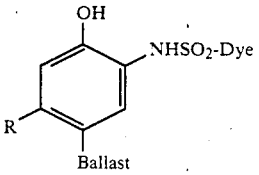

U.S. Pat. No. 4,055,428

-continued

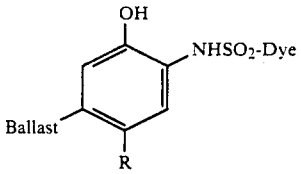

U.S. Pat. No. 4,336,322

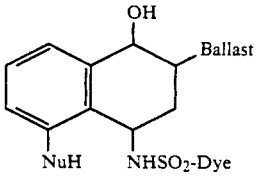

Japanese Patent Application (OPI) No. 65839/84

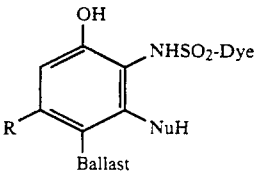

Japanese Patent Application (OPI) No. 69839/84

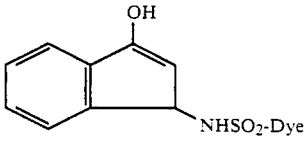

Ballast
Japanese Patent Application (OPI) No. 3819/78

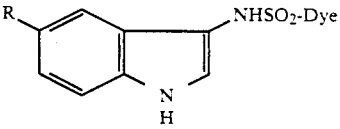

Japanese Patent Applicaiton (OPI) No. 104343/76

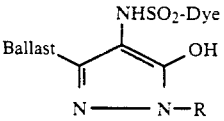

Japanese Patent Application (OPI) No. 104343/76

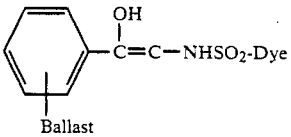

Japanese Patent Application (OPI) No. 104343/76

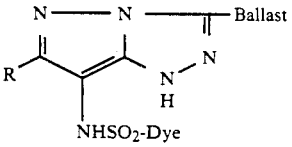

Research Disclosure, RD No. 17465 (Oct., 1978)

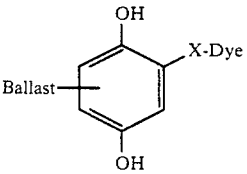

U.S. Pat. No. 3,725,062

-continued

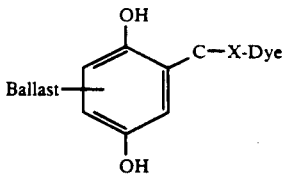

U.S. Pat. No. 3,728,113

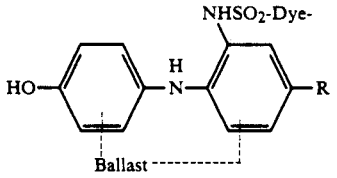

U.S. Pat. No. 3,443,939

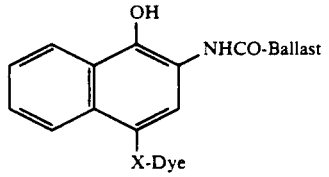

Japanese Patent Application (OPI) No. 116537/83

All of the above described dye providing substances can be used in the present invention.

As specific examples of dye providing substances to be used in the present invention, there are illustrated those which are described in afore-mentioned Japanese Patent Application (OPI) No. 84236/84 (corresponding to U.S. Pat. No. 4,473,631), pp. 60–91. Of these, Compounds (1) to (3), (10) to (13), (16) to (19), (28) to (30), (33), (35), (38) to (40), and (42) to (64) described in the above described patent specification are preferable. In addition, the following cyan and yellow dye providing substances are also useful.

Cyan dye providing substance:

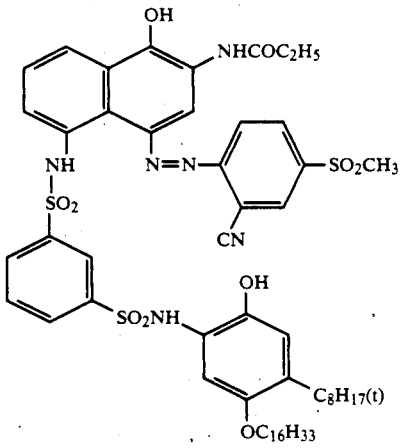

Yellow dye providing substance:

-continued

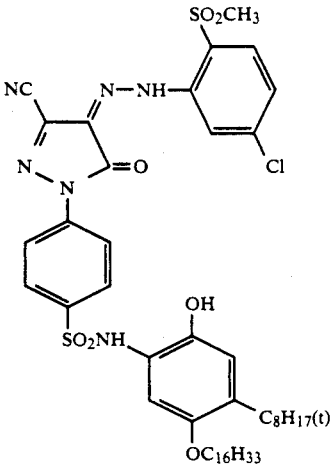

The above described compounds are to be construed as illustrative compounds, and are not limitative at all.

In the present invention, the dye providing substance can be introduced into a layer of a light-sensitive material according to known processes described, for example, in U.S. Pat. No. 2,322,027. In this case, high boiling organic solvents and low boiling organic solvents as described below can be used.

For example, the dye providing substance is dissolved in a high boiling organic solvent such as an alkyl phthalate (e.g., dibutyl phthalate, dioctyl phthalate, etc.), a phosphate (e.g., diphenyl phosphate, triphenyl phosphate, tricresyl phosphate, dioctylbutyl phosphate, etc.), citric ester (e.g., tributyl acetylcitrate, etc.), a benzoic ester (e.g., octyl benzoate, etc.), an alkylamide (e.g., diethyllaurylamide, etc.), an aliphatic ester (e.g., dibutoxyethyl succinate, dioctyl azelate, etc.), a trimesate (e.g., tributyl trimesate, etc.), etc., or an organic solvent having a boiling point of from about 30° C. to about 160° C. such as a lower alkyl acetate (e.g., ethyl acetate, butyl acetate, etc.), ethyl propionate, sec-butyl alcohol, methyl isobutyl ketone, β-ethoxyethyl acetate, methyl cellosolve acetate, cyclohexanone, etc., then the resulting solution is dispersed in a hydrophilic colloid. The above described high boiling organic solvents and the low boiling organic solvents may be mixed to use.

In addition, a dispersing process using a polymer described in Japanese Patent Publication No. 39853/76 and Japanese Patent Application (OPI) No. 59943/76 (corresponding to U.S. Pat. Nos. 4,512,969, 4,304,769, 4,203,716, 4,247,627, 4,214,047 and 4,199,363) may also be employed. In dispersing the dye providing substance in a hydrophilic colloid, various surfactants can be used. As the surfactants, those which are described in different part of this specification can be used.

In the present invention, the high boiling organic solvent is used in an amount of 10 g or less, preferably 5 g or less, per g of the dye providing substance used.

In order to obtain a wide range of colors within the chromaticity diagram using the three primary colors, the heat-developable light-sensitive material to be used in the present invention must contain at least three silver halide emulsion layers having light sensitivity in different spectrum regions.

As typical combinations of the at least three light-sensitive silver halide emulsion layers having light sensitivity in different spectrum regions, there is the combination of a blue-sensitive emulsion layer, a green-sensitive emulsion layer, and a red-sensitive emulsion layer, the combination of a green-sensitive emulsion layer, a red-sensitive emulsion layer, and an infrared light-sensitive emulsion layer, the combination of a blue-sensitive emulsion layer, a green-sensitive emulsion layer, and an infrared light-sensitive emulsion layer, the combination of a blue-sensitive emulsion layer, a red-sensitive emulsion layer, and an infrared light-sensitive emulsion layer, etc. The reference to an infrared light-sensitive emulsion layer means an emulsion having sensitivity to light of 700 nm or more, and particularly 740 nm or more.

The heat-developable light-sensitive material to be used in the present invention may have, if desired, two or more layers having light sensitivity in the same spectrum region and having different sensitivities.

Each of the above described emulsion layers and/or light-insensitive hydrophilic colloid layers contiguous to each of the emulsion layers must contain one of dye providing substances which release or form a yellow hydrophilic dye, dye providing substances which release or form a magenta hydrophilic dye, and dye providing substances which release or form cyan hydrophilic dye. In other words, each of the emulsion layers and/or light-insensitive hydrophilic colloidal layers contiguous to each of the emulsion layers must contain dye providing substances which release or form hydrophilic dyes of different hues. If desired, two or more dye providing substances having the same hue may be used. Preferable stratum structure of the heat-developable light-sensitive material having initially colored dye providing substances is, for example, the sequence of a blue-sensitive emulsion layer, a yellow dye providing substance layer, a green-sensitive emulsion layer, a magneta dye providing substance layer, a red-sensitive emulsion layer, and a cyan dye providing substance layer from the side of exposure to incident light, or the sequence of a green-sensitive emulsion layer containing a yellow dye providing substance, a red-sensitive emulsion layer containing magenta dye providing substance, and an infrared light-sensitive emulsion layer containing cyan dye providing substance.

In order to impart the above described color sensitivities to silver halide emulsions, it suffices to dye-sensitize each emulsion so as to impart desired spectral sensitivity using known sensitizing dyes.

The heat-developable light-sensitive material of the present invention desirably contains a reducing agent. As the reducing agent, there are illustrated the aforesaid dye providing substances having reducing properties as well as those which are generally known as reducing agents. In addition, reducing agent precursors which themselves do not have reducing properties but, in the developing step, exhibit reducibility under the influence of a nucleophilic reagent or heat are also included.

Examples of the reducing agents to be used in the present invention include inorganic reducing agents such as sodium sulfite, sodium hydrogensulfite, etc., benzenesulfinic acids, hydroxylamines, hydrazines, hydrazides, borane.amine complex, hydroquinones, aminophenols, catechols, p-phenylenediamines, 3-pyrazolidinones, hydroxytetronic acid, ascorbic acid, 4-amino-5-pyrazolones, etc. In addition, reducing agents as described in T. H. James, *The Theory of the Photographic Process*, 4th Ed., pp. 291-334, Macmillan & Co., 1977, can be used as well. Furthermore, reducing agent precursors described in Japanese Patent Application (OPI) Nos. 138736/81 (corresponding to U.S. Pat. No. 4,366,240) and 40245/82, U.S. Pat. No. 4,330,617, etc., can also be utilized.

Combinations of various developing agents as disclosed in U.S. Pat. No. 3,039,869 can be used as well.

In the present invention, an image formation accelerating agent can be used. The image formation accelerating agent performs a function of accelerating the oxidation reduction reaction between a silver salt oxidizing agent and a reducing agent, a function of accelerating formation of a dye from a dye providing substance, decomposition of a dye, or release of a mobile dye, and a function of accelerating migration of a dye from a light-sensitive material layer to a dye fixing layer, and is classified in view of physical and chemical functions, as a base or a base precursor, a nucleophilic compound, an oil, a thermal solvent, a surfactant, a compound performing mutual action with silver or silver ion (e.g., a compound which is adsorbed onto a silver or silver ion, or a compound which reacts with a silver or silver ion to form a salt), or the like. However, the accelerating agents generally possess a plurality of these physical and chemical functions, and usually perform some of the above described accelerating functions.

The image formation accelerating agents are classified below according to function, with each class being specifically exemplified. However, the classification is for convenience, and, in fact, one compound often performs a plurality of the functions.

(a) Bases

Preferable examples of bases include inorganic bases such as hydroxides, secondary or tertiary phosphates, borates, carbonates, quinolinates, metaborates of alkali metals or alkaline earth metals, quaternary alkylammonium hydroxides, hydroxides of other metals, etc., and organic bases such as aliphatic amines (trialkylamines, hydroxylamines, aliphatic polyamines, etc.), aromatic amines (e.g., N-alkyl-substituted aromatic amines, N-hydroxyalkyl-substituted aromatic amines, and bis(p-dialkylaminophenyl)methanes, etc.), heterocyclic amines, amidines, cyclic amidines, guanidines, cyclic guanidines, etc. Those which have a pKa of 8 or above are particularly preferable.

(b) Base Precursors

As base precursors, those which undergo some reaction upon being heated to release a base, such as salts between organic acids and bases which are decarboxylated and decomposed by heat, compounds which undergo intramolecular nucleophilic substitution reaction, Lossen rearrangement, Beckmann rearrangement or the like to be decomposed and release an amine, etc., are preferably used. Preferable examples of the base precursors include salts of trichloroacetic acid described in British Patent 998,949, etc., salts of α-sulfonylacetic acid described in U.S. Pat. No. 4,060,420, salts of propiolic acids described in Japanese Patent Application No. 55700/83 (corresponding to U.S. patent application Ser. No. 595,121 (Mar. 30, 1984)), 2-carboxycarboxamide derivatives described in U.S. Pat. No. 4,088,496, thermally decomposable acid salts using as base component alkali metal or alkaline earth metal as well as organic base (Japanese Patent Application No. 69597/83 (corresponding to U.S. patent application Ser. No. 601,758 (Apr. 19, 1984))), hydroxyamcarbamates utilizing Lossen rearrangement and described in U.S. Pat. No. 4,511,650, aldoximecarbamates capable of producing nitrile upon being heated as described in U.S. Pat. No.

4,499,180, etc. In addition, base precursors described in British Patent 998,945, U.S. Pat. No. 3,220,846, Japanese Patent Application (OPI) No. 22625/75, British Patent 2,079,480, etc., are also useful.

(c) Nucleophilic Compounds

Examples include water and water releasing compounds, amines, amidines, guanidines, hydroxylamines, hydrazines, hydrazides, oximes, hydroxamic acids, sulfonamides, active methylene compounds, alcohols, thiols, etc. Salts or precursors of these compounds can be used as well.

(d) Oil

Examples include high boiling organic solvents (called plasticizers) to be used as solvents upon emulsifying and dispersing hydrophilic compounds can be used.

(e) Thermal Solvents

Examples include those which are solid at ambient temperature and which are melted at temperatures around a developing temperature to function as a solvent. Compounds of ureas, urethanes, amides, pyridines, sulfonamides, sulfone sulfoxides, esters, ketones, or ethers, solid at 40° C. or lower can be used.

(f) Surfactants

Examples include pyridinium salts, ammonium salts and phosphonium salts described in Japanese Patent Application (OPI) No. 74547/84 and polyalkylene oxides described in Japanese Patent Application (OPI) No. 57231/84.

(g) Compounds Performing Mutual Action with Silver or Silver Ion

Examples include imides, nitrogen-containing heterocyclic compounds described in Japanese Patent Application (OPI) No. 177550/84, thiols described in British Patent 2,135,465A, thioureas, and thioethers.

The image formation accelerating agent may be incorporated in either of the heat-developable light-sensitive material and the dye fixing material, or in both of them. Layers in which the accelerating agent is to be incorporated may be any of an emulsion layer, an interlayer, a protective layer, an image receiving layer (dye fixing layer), and layers contiguous to these layers. The same applies to an embodiment wherein a light-sensitive layer and a dye fixing layer are provided on the same support.

The image formation accelerating agents may be used alone or as a combination thereof. In general, however, combined use of several kinds of the agents serves to provide more accelerating effects.

In particular, remarkable accelerating effects are obtained by using the base or base precursor and other accelerating agent in combination.

In the present invention, various development stopping agents may be used for the purpose of obtaining definite image characteristics despite variation of processing temperature and processing time upon heat development.

The terminology "development stopping agent" as used herein means those compounds which, after adequate development, rapidly neutralize or react with the base to lower the base concentration in the film and thereby stop the development, or those compounds which perform a mutual action with silver and silver salt to inhibit the development. Specifically, there are illustrated acid precursors capable of releasing an acid upon being heated, electrophilic compounds capable of causing a substitution reaction with the copresent base upon being heated, nitrogen-containing heterocyclic compounds, mercapto compounds, etc. The acid precursors include oxime esters described in Japanese Patent Application Nos. 216928/83 (corresponding to U.S. patent application Ser. Nos. 672,643 (Nov. 19, 1984)) and 48305/84 (corresponding to U.S. patent application Ser. No. 711,885 (Mar. 14, 1985)), compounds capable of releasing an acid as a result of Lossen rearrangement and described in Japanese Patent Application No. 85834/84 (corresponding to U.S. patent application Ser. No. 727,718 (Apr. 26, 1985)), etc., and the electrophilic compounds capable of causing a substitution reaction with a base upon being heated include compounds described in Japanese Patent Application No. 85836/84 (corresponding to U.S. patent application Ser. No. 727,978 (Apr. 26, 1985)), and the like.

The above described development stopping agents exhibit particularly remarkable effects when base precursors are used.

In this case, the ratio of base precursor/acid precursor (molar ratio) preferably ranges from 1/20 to 20/1, and more preferably from 1/5 to 5/1.

In the present invention, compounds which can both stabilize images and activate development may be used. Of these, compounds having a 2-carboxycarboxamido group as acid moiety, such as isothiuroniums represented by 2-hydroxyethylisothiuronium trichloroacetate described in U.S. Pat. No. 3,301,678, bis(isothiuronium)s such as 1,8-(3,6-dioxaoctane)bis(isothiuronium trichloroacetate), etc., described in U.S. Pat. No. 3,669,670, thiol compounds described in West German (OLS) No. 2,162,714, thiazolium compounds such as 2-amino-2-thiazolium trichloroacetate and 2-amino-5-bromoethyl-2-thiazolium trichloroacetate described in U.S. Pat. No. 4,012,260, etc., bis(2-amino-2-thiazolium)-methylenebis(sulfonylacetate) described in U.S. Pat. No. 4,060,420, 2-amino-2-thiazolium phenylsulfonylacetate, etc., are preferably used.

Further, azole thioethers and blocked azolinethione compounds described in Belgian Patent 768,071, 4-aryl-1-carbamyl-2-tetrazoline-5-thione compounds described in U.S. Pat. No. 3,893,859, and those described in U.S. Pat. Nos. 3,839,041, 3,844,788 and 3,877,940 are also preferably used.

In the present invention, image color toning agents may be incorporated, if desired. Effective toning agents include phthalazinones, 1,2,4-triazoles, 1H-tetrazoles, thiouracils, and 1,3,4-thiadiazoles. Preferable examples of the toning agents include phthalazinone, 2-acetylphthalazinone, 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, etc. Particularly effective toning agents are those which can form a black image.

Concentration of the incorporated toning agent varies depending upon kind of the heat-developable light-sensitive material, processing conditions, desired image, and other factors, but, in general, it ranges from about 0.001 to about 0.1 mol per mol of silver in the light-sensitive material.

Binders to be used in the present invention may be incorporated alone or in combination. Hydrophilic binders may be used. Examples of hydrophilic binders include transparent or semitransparent hydrophilic binders, and examples thereof include natural materials such as proteins (e.g., gelatin, gelatin derivatives, etc.) and polysaccharides (e.g., cellulose derivatives, starch, gum arabic, etc.), and synthetic polymer substances such as water-soluble polyvinyl compounds (e.g., polyvinylpyrrolidone, acrylamide polymer, etc.). Further, synthetic polymer substances that can be used include dispersed vinyl compounds which can enhance particularly dimensional stability of photographic materials when used in a latex form.

As to the amount of high boiling organic solvent to be dispersed in the binder together with the hydrophobic compounds, such as dye providing substances in the binder, generally 1 cc or less, preferably 0.5 cc or less, and more preferably 0.3 cc or less, of the solvent is suitable per g of the binder.

The heat-developable light-sensitive material or the dye fixing material of the present invention may contain an inorganic or organic hardener in a photographic emulsion layer, an aforesaid conductive layer, a dye fixing layer, and other binder layer thereof. For example, chromium salts (chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, 1,2-bis(vinylsulfonylacetamido)ethane, etc.), active halogen compounds (e.g., 2,4-dichloro-6-hydroxy-s-triazine, etc.), mucohalogenic acids (e.g., mucochloric acid, mucophenoxychloric acid, etc.), etc., may be used alone or in combination.

The supports to be used in the heat-developable light-sensitive material of the present invention and the dye fixing material to be used in some cases are those which can resist processing temperatures. As general supports, not only glasses, papers, metals, and analogs thereof, but acetylcellulose film, polyvinyl acetal film, polystyrene film, polycarbonate film, polyethylene terephthalate film, and related films or resin materials are used. In addition, paper supports laminated with a polymer such as polyethylene can also be used. Polyesters described in U.S. Pat. Nos. 3,634,089 and 3,725,070 are preferably used.

In the case of using a dye providing substance capable of imagewise releasing mobile dye, dye migration aids may be used for aiding migration of the dye from a light-sensitive layer to a dye fixing layer.

As the dye migration aids, water or a basic aqueous solution containing sodium hydroxide, potassium hydroxide or inorganic alkali metal salts are used in the system of supplying the aids from outside. In addition, low boiling solvents such as methanol, N,N-dimethylformamide, acetone, diisobutyl ketone, etc., or mixtures of these low boiling solvents and water or basic aqueous solution may also be used. The dye migration aids may be used by wetting the image receiving layer with them.

Incorporation of the dye migration aid in the heat-developable light-sensitive material or the dye fixing material eliminates the need for supplying the migration aid from outside. The migration aid may be incorporated in the material as crystal water or microcapsules or as precursor which releases the migration aid at elevated temperatures.

A more preferable system is to incorporate a hydrophilic thermal solvent which is solid at ordinary temperatures and becomes molten at elevated temperatures in a heat-developable light-sensitive material or a dye fixing material. The hydrophilic thermal solvent may be incorporated in either of the heat-developable light-sensitive material and the dye fixing material, or in both of them. Layers in which the solvent is to be incorporated may be any of an emulsion layer, an interlayer, a protective layer, and a dye fixing layer, with the dye fixing layer and/or the contiguous layer thereof being preferable.

Examples of useful hydrophilic thermal solvents include ureas, pyridines, amides, sulfonamides, imides, alcohols, oximes, and other heterocyclic compounds as described in U.S. patent application Ser. No. 590,592 (Mar. 16, 1984).

In the case of incorporating the dye providing substance represented by formula (LI) in the heat-developable light-sensitive material to be used in the present invention, filter dyes or absorbing materials, etc., as described in Japanese Patent Publication No. 3692/73, U.S. Pat. Nos. 3,253,921, 2,527,583, 2,956,879, etc., may be incorporated for improving sharpness of the image, although irradiation preventing or antihalation materials or various dyes are not so necessary since the dye providing substance itself is colored. As the above described dyes, those which are decolored by heat are preferable. For example, dyes as described in U.S. Pat. Nos. 3,769,019, 3,745,009 and 3,615,432 are preferable.

The heat-developable light-sensitive materials to be used in the present invention may contain, if desired, various additives known for heat-developable light-sensitive materials, and layers other than light-sensitive layers, such as protective layers, interlayers, AH (antihalation) layers, release layers, etc. The various additives that can be used include those described in *Research Disclosure*, RD No. 17029 (June, 1978), such as plasticizers, dyes for improving sharpness, AH dyes, sensitizing dyes, matting agents, surfactants, fluorescent brightening agents, antifading agents, etc.

In the case of using dye providing substances capable of forming or releasing dyes upon heat development, the light-sensitive layer and the dye fixing layer may be separately provided on two supports, or may be provided on the same support.

The former type arrangement of providing the light-sensitive layer and the dye fixing layer on different supports can be roughly divided into two groups: one being of peeling-apart type; and the other being peeling-free type. With the former peeling-apart type, the coated surface of a light-sensitive element is superposed on the coated surface of a dye fixing element after imagewise exposure or after heat development, and, after formation of transferred image, the light-sensitive element is rapidly peeled apart from the dye fixing element. As the support of the dye fixing element, an opaque support or a transparent support can be selected depending upon whether the final image is of reflection type or of transparent type. If necessary, a white reflection layer may be provided. With the latter peeling-free type, a white reflection layer must be provided between the light-sensitive layer of a light-sensitive element and the dye fixing layer of a dye fixing element. This white reflection layer may be provided either in the light-sensitive element or in the dye fixing element. The support of the dye fixing element must be transparent.

A typical type of providing the light-sensitive element and the dye fixing element on the same support is that which does not require to peel apart the light-sensitive element from the image receiving element after formation of transferred image. In this case, a light-sensitive layer, a dye fixing layer, and a white reflection layer are provided in sequence on a transparent or semitransparent support. As preferable embodiments, there are illustrated, for example, transparent or opaque support/light-sensitive layer/white reflection layer/dye fixing layer, transparent support/dye fixing layer/white reflection layer/light-sensitive layer, etc.

Another typical type of providing the light-sensitive element and the dye fixing element on the same support is that in which the light-sensitive element is partly or wholly peeled apart from the dye fixing element, as described in Japanese Patent Application (OPI) No. 67840/81, Canadian Patent 674,082, and U.S. Pat. No. 3,730,718, with a release layer being provided in an appropriate position.

Additionally, with peeling-free type, the conductive layer of the present invention is to be provided in a position which does not inhibit exposure and image observation.

The dye fixing material to be used, in some cases, in the present invention has at least one mordant-containing layer, and, where an image receiving layer (dye fixing layer) is positioned on the surface, a protective layer may further be provided, if necessary.

Further, in order to sufficiently incorporate or control the dye migration aid, a water absorbing layer or a dye migration aid-containing layer may be provided. Such layers may be provided contiguous to the dye fixing layer or via an interlayer.

The dye fixing layer to be used in the present invention may, if desired, be constituted of two or more layers using two or more mordants having different mordanting forces.

The mordants to be used in the dye fixing layer are not particularly limited, with polymeric mordants being particularly preferable. The terminology "polymeric mordants" as used herein means polymers containing tertiary amino group, polymers containing a nitrogen-containing heterocyclic moiety, polymers containing a quaternary cationic group therein, etc.

The polymers containing tertiary amino group-containing vinyl monomer units are described in Japanese Patent Application Nos. 169012/83, 166135/83, etc., and specific examples of the polymers containing tertiary imidazole group-containing vinyl monomer units are described in Japanese Patent Application No. 226497/83 (corresponding to U.S. patent application Ser. No. 676,987 (Nov. 30, 1984)), Japanese Patent Application (OPI) No. 122941/85, U.S. Pat. Nos. 4,282,305, 4,115,124, 3,148,061, etc.

Preferable examples of the polymers containing quaternary imidazolium salt-containing vinyl monomer units are described in British Patents 2,056,101, 2,093,041, 1,594,961, U.S. Pat. Nos. 4,124,386, 4,115,124, 4,273,853, 4,450,224, Japanese Patent Application (OPI) No. 28225/73, etc.

Other preferable examples of polymers containing quaternary ammonium salt-containing vinyl monomer units are described in U.S. Pat. Nos. 3,709,690, 3,898,088, 3,958,995, Japanese Patent Application (OPI) Nos. 57836/85, 60643/85, 122940/85 and 122942/85, Japanese Patent Application No. 91620/84 (corresponding to U.S. patent application Ser. No. 731,695 (May 8, 1985)), etc.

In addition to the above described layers, the dye fixing materials can have auxiliary layers such as a release layer, a matting agent layer, a curl-preventing layer, etc.

In one or more of the above described layers there may be incorporated a base and/or base precursor for accelerating migration of dye, a hydrophilic thermal solvent, an agent for preventing mixing of dyes, an ultraviolet ray absorbent, a dispersed vinyl compound for increasing dimensional stability, a fluorescent brightening agent, etc.

The binders in the above described layers are preferably hydrophilic, and transparent or semitransparent hydrophilic colloids are typical. For example, natural materials such as proteins (e.g., gelatin, gelatin derivative, etc.) and polysaccharides such as cellulose derivative, starch, gum arabic, etc.), and synthetic polymer materials such as water-soluble polyvinyl compounds (e.g., dextrin, purlan, polyvinyl alcohol, polyvinylpyrrolidone, acrylamide polymer, etc.) are used. Of these, gelatin and polyvinyl alcohol are particularly effective.

The dye fixing material may contain a reflection layer containing a white pigment such as titanium oxide, a neutralizing layer, a neutralization timing layer, etc., as the case demands, in addition to the above described layers. Such layers may be provided in the heat-developable light-sensitive material as well as in the dye fixing material. Structures of the above described reflection layer, neutralizing layer, and neutralization timing layer are described, for example, in U.S. Pat. Nos. 2,983,606, 3,362,819, 3,362,821, 3,415,644, Canadian Patent 928,559, etc.

As light sources for imagewise exposure of the heat-developable light-sensitive material to record, various radiation wavelengths, including visible light, can be used. In general, various light sources used for ordinary color prints, such as a mercury lamp, a halogen lamp (e.g., iodine lamp), xenon lamp, laser rays, CRT light source, fluorescent tube, light emitting diode (LED), etc., may be used as well as those used for ordinary color prints such as a tungsten lamp.

In the heat developing step, temperatures of from about 80° C. to about 250° C. are enough to conduct development, with from about 110° C. to about 180° C. being useful. Temperatures of 140° C. or above, particularly 150° C. or above, are preferable within this scope. In the case of conducting transfer of dye image, image transfer can be effected by heating to the temperature employed in the heat developing step to room temperature, with a temperature lower than the temperature employed in the heat developing step by about 10° C. being more preferable. As a heating means in one of the developing step and the transferring step, heating means other than the conductive layer of the present invention, such as a simple hot plate, an iron, a hot roller, etc., may be employed.

In the case of using water as a dye migration aid, addition of a water softener such as an organic phosphoric acid compound, a polyphosphoric acid compound represented by sodium hexametaphosphate, sodium tetrapolyphosphate, sodium tripolyphosphate, or potassium salt of each of these polyphosphoric acids, an aminopolycarboxylic acid represented by ethylenediaminetetraacetic acid, nitrilotriacetic acid, triethylenetetraminetetraacetic acid, iminodiacetic acid, hydroxyethyliminodiacetic acid, N-hydroxymethylethylenediaminetetraacetic acid, diethylenetriaminepentaacetic acid, cyclohexanediaminetetraacetic acid, diaminopropanoltetraacetic acid, or the like is preferable for the purpose of preventing transfer unevenness of dye due to precipitation of calcium ion or magnesium ion contained in the water used. The amount of the water softener is not particularly limited, and is appropriately decided depending upon the hardness of the water. Usually, however, it is used in an amount of from 0.001 g to 30 g, and preferably from 0.01 g to 10 g, per liter of water.

Since the photographic material of the present invention has an electrically conductive layer which undergoes remarkably low fluctuation in the electric resistance thereof for the change of humidity, energizing conditions can be easily selected, and heating unevenness in each energization can be reduced to provide beautiful images always having good density characteristics.

In addition, a hydrophilic binder is used as the binder for the conductive layer provided in the photographic material of the present invention, and hence workability and safety upon coating are improved and, in the case of providing the emulsion layer and the conductive layer respectively on both sides of a support, an extremely good curl balance of the photographic material can be attained.

The present invention is now illustrated in more detail by reference to the following examples; the examples are not to be construed as limiting the present invention in any way. Unless otherwise indicated, all parts, percents, ratios are by weight.

EXAMPLE 1

Carbon black having a dibutyl phthalate (DBP) absorption capability of 350 cc/100 g was phase-dispersed together with a dispersing agent according to the formulation

| | |
|---|---|
| Carbon black (350 cc/100 q in DBP absorption capability) | 45 g |
| Demol N (Kao Atlas Co.) | 5 g |
| Nissan Nonion NS208.5 (5% aq. soln.) | 54 cc |
| Water | 600 cc |
| 10% Gelatin aqueous solution | 600 g |
| 10% Solution of sodium 2-ethylhexyl sulfosuccinate (water/methanol (volume) = 1/1) | 190 cc |

then dispersed in a colloid mill to prepare a coating solution of a carbon black dispersion.

The above described dispersion was coated on polyethylene terephthalate in a wet thickness of 90 μm to prepare Sample A.

Resistance of this Sample A was measured at 25° C. and 20% relative humidity (RH), and at 25° C. and 80% RH to obtain ratio of R (80% RH)/R (20% RH). The results are set forth in Table 1.

Further, Samples B, C, D, and E (comparative sample) were prepared according to the same formulation and the same procedures as with Sample A, except for using carbon black as set forth in Table 1 in place of the carbon black having a DBP absorption capability of 350 cc/100 g.

Samples B, C and D according to the present invention and Sample E (comparative sample) described above were also subjected to the same measurement as with Sample A to obtain R (80% RH)/R (20% RH) ratios. The results thus obtained are tabulated in Table 1.

TABLE 1

| Sample No. | DBP Absorption Capability (cc/100 g) | R (80% RH)/R (20% RH) |
|---|---|---|
| A (Invention) | 350 | 1.1 |
| B (Invention) | 178 | 1.2 |
| C (Invention) | 115 | 1.3 |
| D (Invention) | 83 | 1.5 |
| E (Comparison) | 55 | 3.0 |

As is clear from the above described results, samples in accordance with the present invention containing carbon black having a DBP absorption capability of 80 cc/100 g or more were demonstrated to show that the resistance variation for the change of relative humidity between 20% RH and 80% RH presented as a resistance ratio, R (80% RH)/R (20% RH), was controlled within the scope of from 1/1 to 1.5/1.

EXAMPLE 2

A light-sensitive layer as described below was coated on the opposite side of each of the supports having, respectively, electrically conductive layers of A, B, C, and D according to the present invention, and E (comparative sample), as prepared in Example 1, and the conductive layer side was energized at 25° C. and 20% RH or 80% RH to form a color image.

Preparation of Light-Sensitive Silver Halide Emulsion 40 g of gelatin and 26 g of KBr were dissolved in 3,000 ml of water, and the resulting solution was maintained at 50° C. and stirred.

Then, a solution of 34 g of silver nitrate in 200 ml of water was added to the above described solution in 10 minutes, and the pH of this silver bromoiodide emulsion was adjusted to flocculate the emulsion and remove excess salts. Subsequently, the pH was adjusted to 6.0, to obtain 400 g of a silver bromoiodide emulsion.

Preparation of Emulsion of Silver Benzotriazole Salt 28 g of gelatin and 13.2 g of benzotriazole were dissolved in 3,000 ml of water, and this solution was maintained at 40° C. and stirred.

Then, a solution of 17 g of silver nitrate in 100 ml of water was added to this solution in 2 minutes, and the pH of the resulting emulsion of Silver Benzotriazole Salt was adjusted to flocculate the emulsion and remove excess salts, followed by adjusting the pH to 6.3 to obtain 400 g of an emulsion of silver benzotriazole salt.

5 g of dye providing substance (a) was added to a mixture of 10 g of tricresyl phosphate and 30 ml of ethyl acetate, and heated to about 60° C. to dissolve it. This solution was mixed with 100 g of a 10% aqueous solution of gelatin and 10 ml of a 5% aqueous solution of sodium p-alkylbenzenesulfonate (alkyl groups: mixture of $C_{12}$ and $C_{13}$) and stirred, followed by dispersing in a homogenizer for 10 minutes at 10,000 rpm. This dispersion was referred to as a dispersion of dye providing substance.

Chemical Formula of Dye Providing Substance (a):

-continued

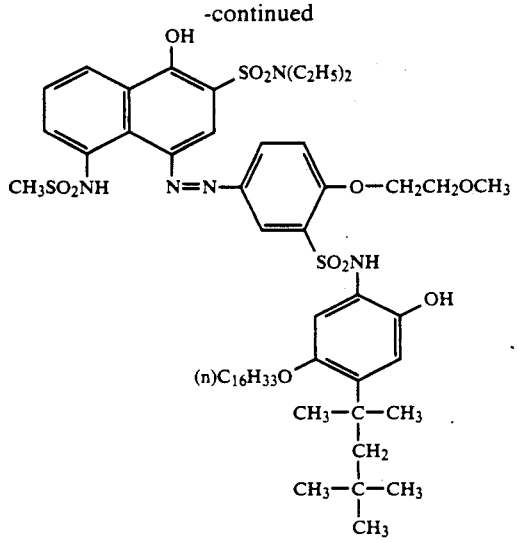

Light-sensitive materials were prepared as follows.

The following light-sensitive layer was coated on the back side of each of supports of Samples A to E prepared in Example 1 to obtain Light-Sensitive Materials (I) to (V).

| | | |
|---|---|---|
| (a) | Silver bromoiodide emulsion | 20 g |
| (b) | Silver benzotriazole salt emulsion | 10 g |
| (c) | Water | 3.5 ml |
| (d) | Dispersion of dye providing substance (a) | 33 g |
| (e) | 5% Aqueous solution of a compound having the following structure: 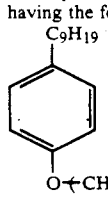 | 5 ml |
| (f) | 10% Ethanol solution of guanidine trichloroacetate | 12.5 ml |
| (g) | 10% Aqueous solution of dimethylsulfamide | 4 ml |

The above described ingredients (a) to (g) were mixed to prepare a solution, and the resulting solution was coated in a wet thickness of 30 μm on a polyethylene terephthalate film, then dried. Further, the following composition was coated thereon as a protective layer.

| | | |
|---|---|---|
| (i) | 10% Gelatin aqueous solution | 35 g |
| (ii) | 10% Ethanol solution of guanidine trichloroacetate | 5 ml |
| (iii) | 1% Aqueous solution of sodium 2-ethylhexyl sulfosuccinate | 4 ml |
| (iv) | Water | 56 ml |

A solution prepared by mixing the above described (i) to (iv) was coated in a wet thickness of 25 μm, then dried to prepare light-sensitive materials.

A dye fixing material was prepared as follows.

10 g of poly(methyl acrylate/co-N,N,N-trimethyl-N-vinylbenzylammonium chloride) (mol ratio of methyl acrylate to vinylbenzylammonium chloride=1/1) was dissolved in 200 ml of water, then uniformly mixed with 100 g of 10% aqueous solution of lime-processed gelatin. This mixed solution was uniformly coated in a wet thickness of 90 μm on a paper support laminated with titanium dioxide-containing (in a dispersed state) polyethylene. After being dried, this was used as a dye fixing material having a mordanting layer.

Above described Light-Sensitive Materials (I) to (V) were imagewise exposed for 10 seconds at 2,000 lux using a tungsten bulb.

Then, a direct current of 300 v was applied thereto for 15 seconds using roller type electrodes at 25° C. and 20% RH or 80% RH.

Subsequently, the dye fixing material was dipped in water, and superposed on each of the heated light-sensitive materials with coated sides facing each other. After being heated for 6 seconds on an 80° C. heat block, the dye providing material was peeled apart from the light-sensitive material to obtain a negative magenta color image on the dye fixing material.

As a result, it was demonstrated that Light-Sensitive Materials (I), (II), (III) and (IV) provided distinct images, undergoing a reduction within 10% of the maximum density when the ambient humidity was changed from 20% RH to 80 R RH, with energizing conditions being the same.

On the other hand, Light-Sensitive Material (V) (comparative sample) gave images different in maximum density as 2.2 and 1.7 (reduction of maximum density: 23%) corresponding to the humidity of 20% and 80%. Therefore, it was demonstrated that the use of a conductive layer containing carbon black having a dibutyl phthalate absorption capability of 80 cc/100 g always gave about the same beautiful images even when ambient humidity was changed.

EXAMPLE 3

Preparation of Light-Sensitive Material (XI)

Light-Sensitive Material (XI) was prepared in the same manner as in Example 2, except for using dye providing substance (b) of the following structure in place of dye providing substance (a) used in the light-sensitive layer of Light-Sensitive Material (I). A gelatin dispersion of dye providing substance (b) of the following structure was prepared in the same manner as in Example 1 except for using dye providing substance (b) in place of dye providing substance (a) used in Example 2.

Structural Formula of Dye Providing Substance (b):

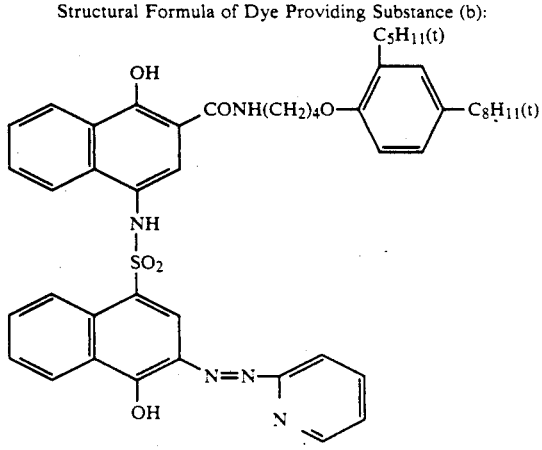

Preparation of Dye Fixing Material

On a polyethylene terephthalate support coated with titanium dioxide were coated a 1/1 (by weight) mixture of polyacrylic acid (polymerization degree: 2,000) and polyvinyl alcohol in an amount of 2 g/m$^2$ and nickel sulfate in an amount of 0.5 g/m$^2$. Then, a solution prepared by uniformly mixing 100 g of a 10% aqueous solution of polyvinylimidazole, 120 g of 10% aqueous solution of polyvinyl alcohol (saponification degree: 98%; polymerization degree: 2,000), 10 g of urea, and 26 g of N-thiourea was coated thereon in a wet thickness of 70 μm, and dried to obtain dye fixing material 2.

The above described light-sensitive material was exposed in the same manner as in Example 2, then processed together with dye fixing material 2 in the same manner as in Example 2 to obtain images having high negative density. The resulting images suffered no adverse influences due to humidity.

EXAMPLE 4

Dye fixing material 3 was prepared as follows.

0.75 g of gelatin hardener H-1, 0.25 g of H-2, 2.5 g of nickel sulfate, and 160 ml of distilled water were mixed, and 100 g of 10% aqueous solution of acid-processed gelatin was added thereto, followed by uniform mixing. This mixed solution was uniformly coated in a wet thickness of 60 μm on a paper support laminated with titanium dioxide-containing (in a dispersed state) polyethylene, then dried.

Gelatin Hardener H-1:

$$CH_2{=}CHSO_2CH_2CONHCH_2CH_2NHCOCH_2SO_2CH{=}CH_2$$

Gelatin Hardener H-2:

$$CH_2{=}CHSO_2CH_2CONHCH_2CH_2CH_2CH_2NHCOCH_2SO_2CH{=}CH_2$$

Then, 200 ml of distilled water was added to 10 g of a polymer of the following structure and 100 g of 10% aqueous solution of lime-processed gelatin, followed by uniformly coating the resulting uniform mixture on the above described coat. This sample was dried to be used as dye fixing material 3.

Polymer:

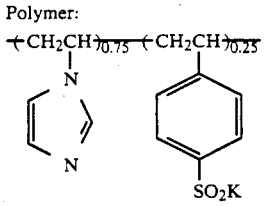

$[\eta]$g/dl=0.4

The value of $[\eta]$g/dl was measured at 30° C. in a mixed solvent of 0.2M disodium phosphate aqueous solution and acetonitrile (8/2 volume ratio).

When the same process steps as in Example 2 were conducted using Light-Sensitive Material (XI) prepared in Example 3 and dye fixing material 3, an image with high negative density appeared on the dye fixing material. This image had an extremely excellent fading resistance, and suffered no influences of ambient humidity.

While the invention has been described in detail and with reference to specific embodiments thereof, it will be apparent to one skilled in the art that various changes and modifications can be made therein without departing from the spirit and scope thereof.

What is claimed is:

1. A process for forming an image in a photographic material containing a support having provided thereon (a) a photographic layer in the form of a heat developable light-sensitive layer or an image receiving layer and (b) at least one electrically conductive layer, comprising, after image-wise exposing the heat developable light-sensitive layer:

electrically energizing the conductive layer to generate sufficient heat to (1) raise the temperature of said photographic layer to a temperature which heat develops the light-sensitive layer, or (2) raise the temperature of said photographic layer to a temperature which heat develops the light-sensitive layer and transfers a mobile dye resulting from the heat development of the light-sensitive layer to an image receiving layer, or (3) transfer a mobile dye resulting from heat development of the light-sensitive layer to an image-receiving layer, wherein the electrically conductive layer comprises carbon black having a dibutyl phthalate absorption capability of at least 150 cc/100 g and a hydrophilic binder.

2. A process as in claim 1, wherein said hydrophilic binder is at least one member selected from gelatin and polyvinyl alcohol.

3. A process as in claim 1, wherein said hydrophilic binder is gelatin.

4. A process as in claim 2, wherein said hydrophilic binder additionally comprises a hydrophilic electically conductive polymer.

5. A process as in claim 1, wherein the volume resistance of the electrically conductive layer is from $10^{-4}$ to $10^4$ Ω cm, and the carbon black comprises from 10 to 90 wt % of the electrically conductive layer.

6. A process as in claim 1, wherein the carbon black is present in the electrically conductive layer in an amount of from about 2 g to 20 g/m$^2$.

7. A process as in claim 1 in which the light-sensitive layer comprises a silver halide and a binder.

8. A process as in claim 1 in which the light-sensitive layer comprises a silver halide, a dye providing substance and a binder.

9. A process as in claim 1 in which the image receiving layer contains a mordant.

10. A process as in claim 1 in which the electrically conductive layer is provided on the opposite side of the support with respect to the light-sensitive layer or the image layer.

11. The process according to claim 1, wherein the temperature is raised to about 80° C. to about 250° C. to bring about heat development or image transfer.

12. The process according to claim 1, wherein the transfer occurs at a temperature of about 70° C. to about 240° C.

13. The process according to claim 1, wherein the temperature is raised to about 80° C. to about 250° C. to bring about heat development and to about 70° C. to about 240° C. to effect transfers of the mobile dye.

* * * * *